US007402023B2

(12) United States Patent
Kupidlowski

(10) Patent No.: US 7,402,023 B2
(45) Date of Patent: Jul. 22, 2008

(54) SANITARY MIXING ASSEMBLY FOR VESSELS AND TANKS

(75) Inventor: Frank Kupidlowski, Oregon City, OR (US)

(73) Assignee: J.V. Northwest, Inc., Canby, OR (US)

( * ) Notice: Subject to any disclaimer, the term of this patent is extended or adjusted under 35 U.S.C. 154(b) by 524 days.

(21) Appl. No.: 11/049,590

(22) Filed: Jan. 31, 2005

(65) Prior Publication Data

US 2005/0175464 A1 Aug. 11, 2005

Related U.S. Application Data

(62) Division of application No. 10/155,831, filed on May 22, 2002, now Pat. No. 6,866,414.

(60) Provisional application No. 60/292,993, filed on May 22, 2001.

(51) Int. Cl.
*B01F 7/22* (2006.01)
*F04D 29/056* (2006.01)

(52) U.S. Cl. ..... 415/111; 415/142; 415/170.1; 415/229; 416/174; 384/435

(58) Field of Classification Search ..... 366/331; 384/226, 240, 243, 420, 435; 248/151, 158, 248/188.7; 415/111–112, 142, 170.1, 229; 416/174

See application file for complete search history.

(56) References Cited

U.S. PATENT DOCUMENTS

| | | | | |
|---|---|---|---|---|
| 904,656 | A | | 11/1908 | Steiger |
| 1,473,066 | A | | 11/1923 | Wells |
| 1,508,086 | A | | 9/1924 | Crawford |
| 1,977,072 | A | | 10/1934 | Lyman |
| 1,995,193 | A | | 3/1935 | Stilphen |
| 2,684,723 | A | | 7/1954 | Faber |
| 3,014,534 | A | | 12/1961 | Vartiainen |
| 3,379,415 | A | * | 4/1968 | Logue ..... 366/330.1 |
| 4,025,131 | A | * | 5/1977 | Bergquist et al. ..... 384/428 |
| 4,147,437 | A | | 4/1979 | Jonqueres |
| 4,364,712 | A | | 12/1982 | Charles |
| 4,468,130 | A | | 8/1984 | Weetman |
| 4,519,715 | A | | 5/1985 | Golobic et al. |
| 4,601,583 | A | | 7/1986 | Amorese |
| 4,721,394 | A | | 1/1988 | Casto et al. |
| 4,722,608 | A | | 2/1988 | Salzman et al. |
| 4,932,787 | A | * | 6/1990 | Fasano ..... 366/246 |
| 5,161,953 | A | | 11/1992 | Burtis |
| 5,297,938 | A | | 3/1994 | Von Essen et al. |

(Continued)

FOREIGN PATENT DOCUMENTS

JP 58-8824 A * 1/1983

*Primary Examiner*—Christopher Verdier
(74) *Attorney, Agent, or Firm*—Kolisch Hartwell, P.C.

(57) ABSTRACT

Component parts for a mixing assembly adapted to be used with clean in place techniques. The component parts may include an impeller assembly, an adjustable hub assembly, and a steady bearing assembly. The bearing assembly may include a supporting structure having a fitting and a plurality of legs extending from the fitting and securely engaging the vessel, and a guide bearing bore adapted to receive a shaft, wherein the guide bearing is adapted to be removably engaged from the supporting structure and wherein the guide bearing is removable from the supporting structure shaft without necessitating removal or lifting of the shaft.

8 Claims, 4 Drawing Sheets

U.S. PATENT DOCUMENTS 5,316,443 A 5/1994 Smith
5,326,168 A 7/1994 Miura
5,568,975 A * 10/1996 Blakley et al. ..... 366/285
5,618,107 A * 4/1997 Bartsch ..... 366/279
5,813,837 A 9/1998 Yamamoto et al.
5,887,982 A * 3/1999 Wilcher ..... 384/97
5,951,162 A 9/1999 Weetman et al.
6,116,856 A 9/2000 Karadgy et al.
6,299,412 B1 10/2001 Wood et al.
6,334,705 B1 1/2002 Weetman
6,386,753 B1 * 5/2002 Blakley ..... 366/331

* cited by examiner

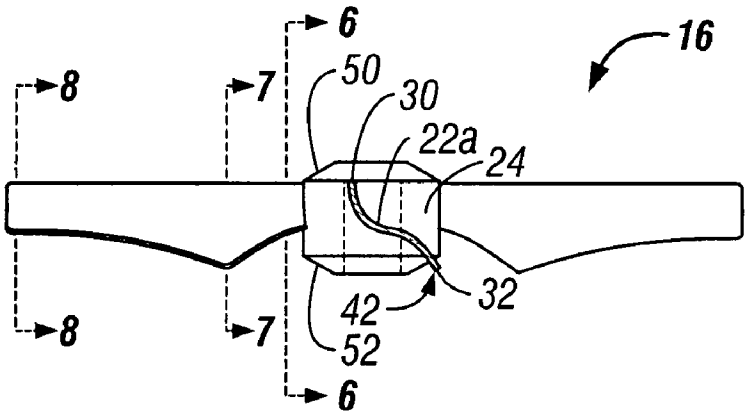
FIG. 5
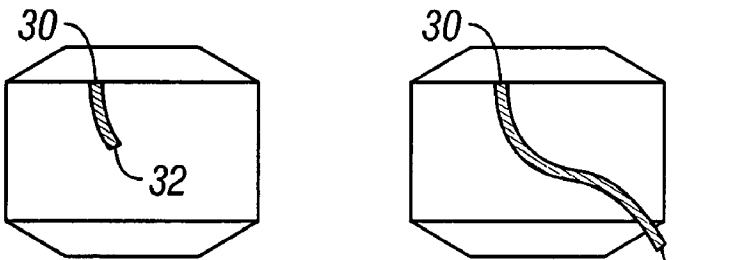
FIG. 6
FIG. 7
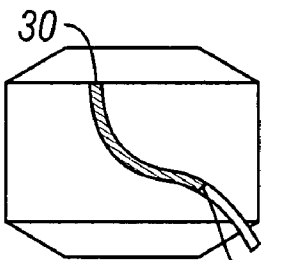
FIG. 8

SANITARY MIXING ASSEMBLY FOR VESSELS AND TANKS

CROSS REFERENCE TO RELATED APPLICATIONS

This application is a divisional patent application of, and claims priority to, U.S. patent application Ser. No. 10/155,831, which was filed on May 22, 2002 now U.S. Pat. No. 6,866,414, and which claims priority to U.S. Provisional Patent Application Ser. No. 60/292,993, filed May 22, 2001, entitled "Sanitary Mixing Apparatus for Vessels." The complete disclosures of the above-identified patent applications are hereby incorporated by reference in their entirety for all purposes.

BACKGROUND OF THE INVENTION

Sanitary mixing vessels and tanks are used in a wide variety of applications including the food, dairy, beverage, pharmaceutical, and cosmetic industries. Typically, the mixing vessel employs a mixing assembly including a shaft and a rotating impeller blade to mix the contents of the vessel. In many industries, including those mentioned above, it is vitally important that the mixing assembly be thoroughly cleaned between uses. As will be appreciated, it is also important that the mixing assembly, and any component parts, be cleaned in a quick, efficient and cost-effective manner.

SUMMARY OF THE INVENTION

In one embodiment, the present disclosure provides a bearing assembly for a mixing vessel. The bearing assembly may include a supporting structure having a fitting and a plurality of legs extending from the fitting. The legs are typically secured to the vessel. The bearing assembly may further include a guide bearing having a bore adapted to receive a shaft. The guide bearing is typically adapted to be removably engaged by the supporting structure. Moreover, the guide bearing may be removable from the supporting structure and shaft without necessitating removal or lifting of the shaft.

In another embodiment, the present disclosure provides a mixing assembly for a vessel including a shaft, an impeller assembly, a hub assembly and a bearing assembly.

The advantages of the present invention will be understood more readily after a consideration of the drawings and the Detailed Description.

BRIEF DESCRIPTION OF THE DRAWINGS

FIG. 5 is a side view of the impeller assembly shown in FIG. 1.

FIG. 6 is a cross-section of a blade of the impeller assembly of FIG. 5 taken along the line 6-6.

FIG. 7 is a cross-section of a blade of the impeller assembly of FIG. 5 taken along the line 7-7.

FIG. 8 is a cross-section of a blade of the impeller assembly of FIG. 5 taken along the line 8-8.

DETAILED DESCRIPTION AND BEST MODE OF THE INVENTION

The present invention provides a mixing assembly including component parts that can be easily cleaned in a sanitary mixing vessel or tank.

Figure 1:
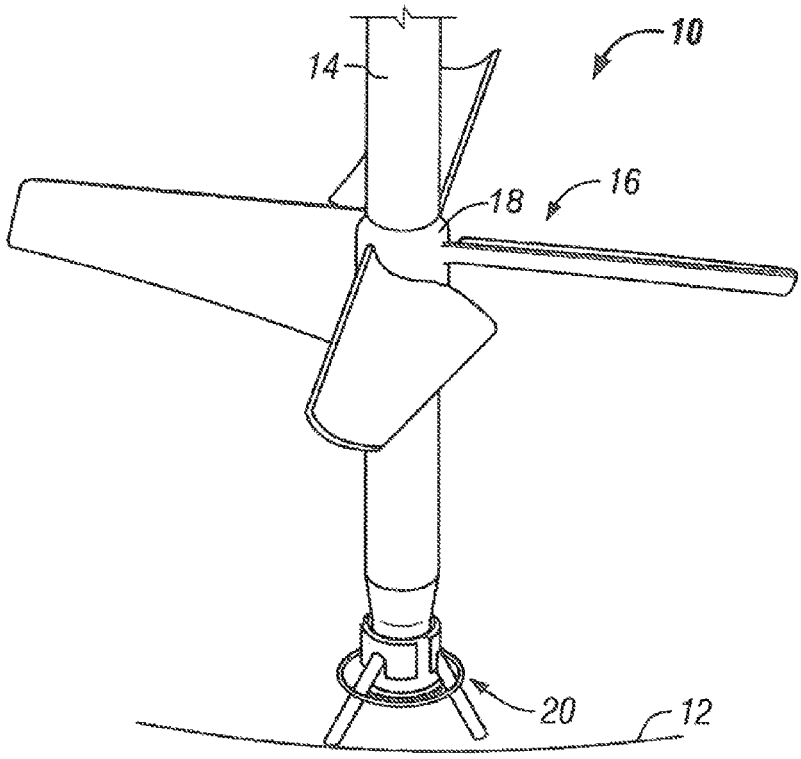
FIG. 1 is an isometric view of one embodiment of a mixing assembly according to the present invention.
Figure 2:
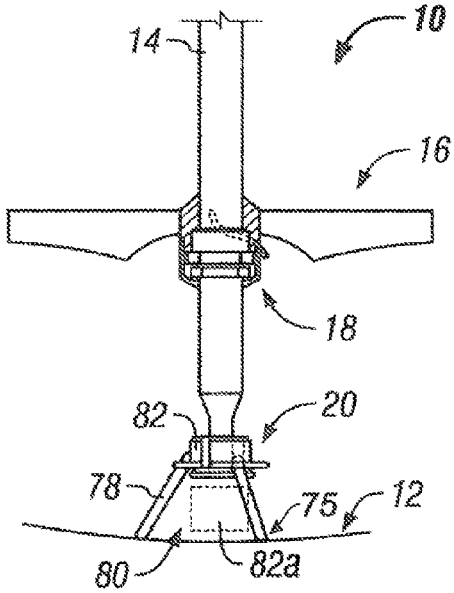
FIG. 2 is a side view of another embodiment of a mixing assembly according to the present invention.

Mixing assemblies according to the present invention are shown in FIGS. 1 and 2. Mixing assembly 10 is generally adapted for use in a vessel 12 and includes a shaft 14, an impeller assembly 16, an adjustable hub assembly 18, and a steady bearing assembly 20. As shown, impeller assembly 16 is rotatably engaged with shaft 14 via adjustable hub assembly 18. Generally, one end of shaft 14 is secured to a motor drive (not shown) to rotate the shaft within vessel 12. If necessary or desired, the non-secured end of shaft 14 may be steadied via bearing assembly 20. Each of the components may be made of stainless steel or any other suitable material.

As will be appreciated, impeller assembly 16, adjustable hub assembly 18, and steady bearing assembly 20 are each component parts of mixing assembly 10 and may, therefore, be used separately or in combination with each other or other component parts. For example, a steady bearing is not required for all applications, in which case mixing assembly 10 may include impeller assembly 16 and adjustable hub assembly 18 but not steady bearing assembly 20. As another example, as will be discussed in further detail below, the impeller assembly 16 may be used in combination with any suitable hub including a welded hub as shown in FIGS. 3-8 or an adjustable hub such as that shown in FIGS. 2 and 9.

Each component of mixing assembly 10 is adapted to be adequately washed or cleaned using a method known as "clean in place" (CIP). Typically, CIP methods involve spraying cleaning and sanitizing fluids into the vessel and onto the surfaces of vessel's internal components without removing or disassembling any of the internal components. Moreover, according to the present invention, each component of mixing assembly 10 is adapted to be easily and thoroughly cleaned when a cleaning or sanitizing fluid is sprayed towards mixing assembly 10 from a single direction. Typically, the CIP process is performed while the mixing assembly is being rotated.

Figure 3:
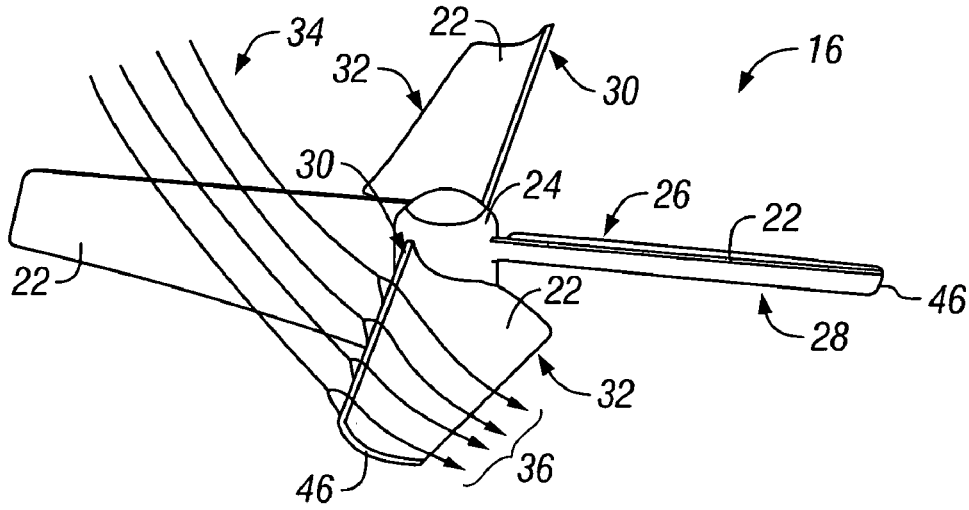
FIG. 3 is a perspective view of an impeller assembly according to the present invention.

FIG. 3 is a perspective view of one embodiment of impeller assembly 16. Impeller assembly 16 is shown with impeller blades 22 extending from a central hub 24. Impeller assembly 16 may include four blades, as shown. However, as will be appreciated, impeller assemblies having more than four or fewer than four blades may be desirable and are contemplated by the present invention.

As shown, each blade 22 has a top surface 26, a bottom surface 28, a leading edge 30, and a trailing edge 32. The "top surface" as used in the present discussion, shall be defined as that surface towards which fluid spray 34 is initially directed. According to the present invention, the leading edge 30 of each blade may be curved such that the curvature of the leading edge directs at least a portion of the liquid initially aimed at top surface 26 towards bottom surface 28, as shown by arrows 36. Thus, fluid may be delivered to both the top and bottom surfaces of the blade without requiring that the fluid be expelled from multiple sources in the mixing vessel. For example, fluid need not be sprayed from sources located both above and below impeller assembly 16 in order to thoroughly rinse both sides of blades 22.

Figure 4:
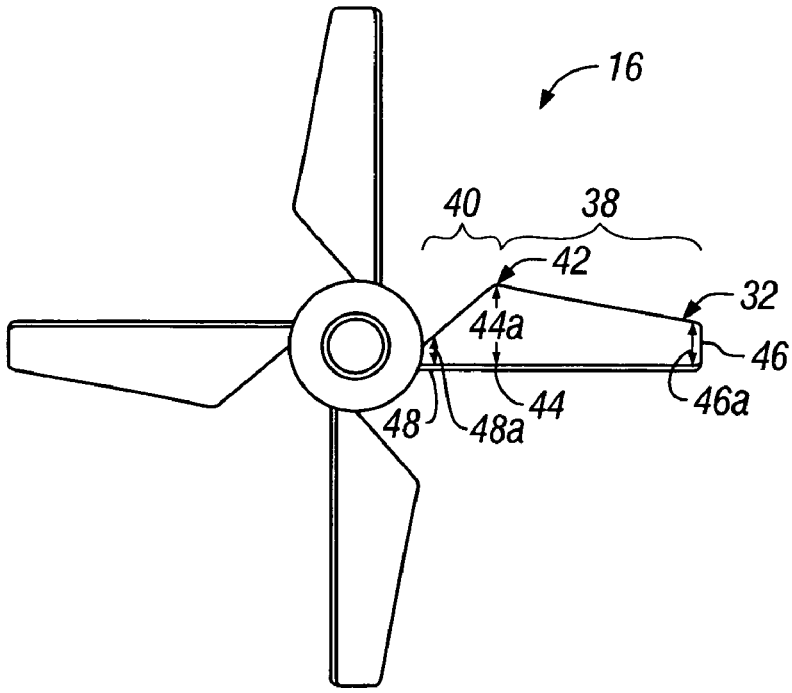
FIG. 4 is a plan view of the impeller assembly shown in FIG. 1.

FIG. 4 is a plan view of the impeller assembly of FIG. 3. As shown, trailing edge 32 may be bidirectionally tapered with an outer region 38 being generally tapered outwards and an inner region 40 being generally tapered inwards, forming an apex 42. Thus, blade 22 may have a central region 44 having a width 44*a* greater than width 46*a* of distal edge 46. As shown, width 46*a* of distal edge 46 is greater than width 48*a* of attachment edge 48. However, it is contemplated that widths 46*a* and 48*a* may vary in relationship to each other. Likewise, in the embodiment shown, inner region 40 is approximately one-third the total length of blade 22. However, it is contemplated that the ratio of inner region 40 to outer region 38 may be greater or lesser than that depicted in FIG. 4.

FIG. 5 is a side view of the impeller assembly of FIG. 3. FIG. 6 is a cross-section of FIG. 5 taken along the line 6-6. By comparing FIGS. 4, 5, and 6, it can be seen that inner region 40 may be sufficiently tapered such that most, if not all, of attachment edge 48 adjacent hub 24 is at a near vertical pitch.

Returning to FIG. 5, it can be seen with reference to blade 22*a*, that at the widest point, i.e. in the region of the blade corresponding to central portion 44, the curvature of blade 22*a* may be roughly s-shaped, beginning at leading edge 30 with a near vertical pitch, curving to a near horizontal pitch in the middle and ending with a near vertical pitch at apex 42 on trailing edge 32. This S-shape is also seen in FIG. 7, which is a cross-section of blade 22*a* in FIG. 5, taken along line 7-7, the widest point of the blade.

Moreover, as shown in cross-section in FIG. 8, due to the tapering of trailing edge 32, as described above, distal edge 46 may have a generally L-shaped conformation, beginning with a near vertical pitch at leading edge 30 and ending with a near horizontal pitch at trailing edge 32. As shown in FIG. 3, the trailing edge at this point may have a slight downward pitch.

Returning to FIG. 5, hub 24 may be a welded hub to which blades 22 are permanently attached. Welded hub 24 may include tapered opposing surfaces 50 and 52. As will be appreciated, alternative hubs may be used in conjunction with impeller assembly 16, including the adjustable hub shown in FIG. 1 and described in greater detail below.

Figure 9:
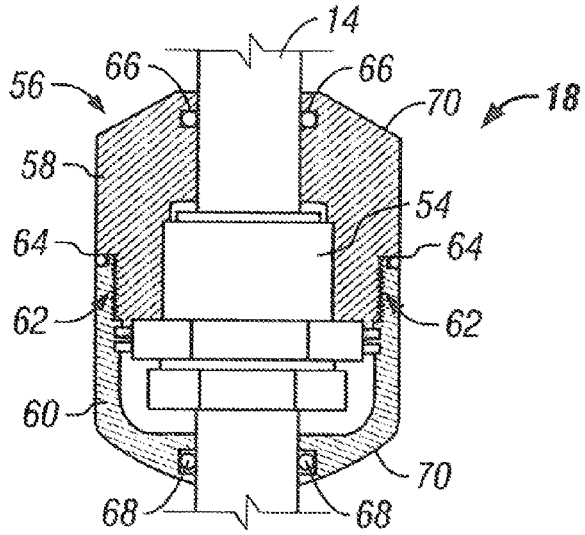
FIG. 9 is a side view of the hub assembly shown in FIG. 2.

FIG. 9 is a side sectional view of an adjustable hub assembly 18 according to the present invention. Adjustable hub assembly 18 rotatably engages impeller assembly 16 to shaft 14 via a bushing 54, which may act as a two-way compression fitting. The bushing may be of any suitable type including those generally referred to as keyless bushings and described in U.S. Pat. Nos. 4,202,644, 4,600,334, and 5,696,296, each of which is incorporated by reference in its entirety for all purposes. The adjustable hub assembly 18 further includes a housing 56 adapted to receive the bushing. The housing includes a first region 58 and a second region 60. Typically, the first and second regions are configured to sealingly engage each other, such as through a screw type connection 62. If desired, a static seal, such as o-ring 64 may be placed at the intersection of the first region 58 and second region 60 to ensure water tightness. Additional static seals, such as 0-rings 66 and 68 may be employed to ensure a water-tight seal between housing 56 and shaft 14. As will be appreciated, the static seal may take any suitable form including a molded square gasket or the like.

As will be appreciated, adjustable hub assembly 18 may be used with any style of impeller. Typically, the impeller blades are mounted to first region 58. In one particularly desirable combination, impeller blades of the style discussed above with respect to FIGS. 3-8 are mounted to first region 58. As with hub 24, the outer ends of housing 56 may be tapered, as shown at 70.

Figure 10:
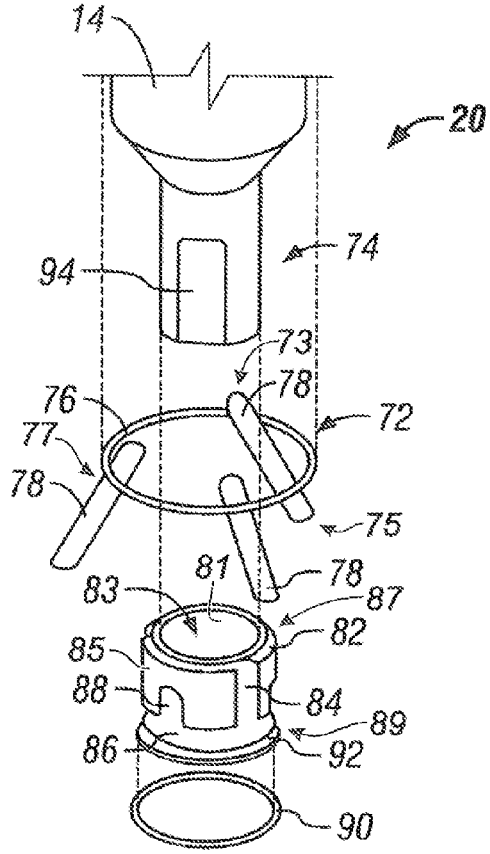
FIG. 10 is an exploded view of the steady bearing assembly shown in FIGS. 1 and 2.

FIG. 10 is an exploded view of a bearing assembly 20 according to the present invention. Bearing assembly 20 includes a supporting structure 72. Support structure 72 may include a fitting 76 having a plurality of legs, or nubbins, 78 extending from the fitting. More specifically, FIG. 10 shows that each leg 78 includes a top end 73, a bottom end 75, and a middle portion 77 extending therebetween, the middle portion being coupled to the fitting. Supporting structure 72 may be adapted to removably receive bearing 82. Bearing 82, shown in the figures to have a generally cylindrical shape, includes an interior surface 81 that defines a bore 83, which is adapted to receive a bearing contact area 74 at the end of shaft 14.

Turning briefly to FIG. 2, bottom ends 75 of nubbins 78 are typically secured to mixing vessel 12. Nubbins 78 generally extend outward, from the top ends to the bottom ends, so as to provide a space 80 through which bearing 82 may be removed or inserted, as shown by bearing 82*a*. This structure allows for the installation and removal of bearing 82 without necessitating removal or lifting of shaft 14.

Returning to FIG. 10, bearing 82 is shown to have an exterior surface 85 extending between a top edge 87 and a bottom edge 89. A generally horizontally oriented channel 86 extends around the exterior surface of the bearing adjacent to bottom edge 89, and vertically oriented slots 84 extend from the channel to the top edge of the bearing. Grooves 88 extend upward from channel 86 and terminate partway toward the top edge. As set forth below, an o-ring 90 may be installed, which may take any suitable form, and shaft 14 may include one or more milled flats 94. To install bearing 82 according to the illustrated configuration, slots 84 in bearing 82 are aligned with top ends 73 of nubbins 78 on supporting structure 72. Bearing 82 is inserted from underneath shaft 14 and rotated, so that top ends 73 of nubbins 78 slide along channel 86 until the top ends engage and set into grooves 88. This configuration minimizes the contact area between nubbins 78 and bearing 82. This minimization of the contact area eliminates shadowing of cleaning solution and maximizes the area of the entire assembly that is exposed to the cleaning solution (and thus cleaned).

If desired, a static seal such as o-ring 90 may be installed around lower lip 92 of bearing 82. As will be appreciated, the static seal may take any suitable form including as a molded square gasket or the like.

Shaft 14 may include one or more milled flats 94 in bearing contact area 74. The milled flats 94 may allow cleaning solutions onto the bearing surfaces for ease of cleaning.

The subject matter of the inventions includes all novel and non-obvious combinations and subcombinations of the various elements, features, functions and/or properties disclosed herein. Similarly, where the disclosure recites "a" or "a first" element or the equivalent thereof, such disclosure should be understood to include incorporation of one or more such elements, neither requiring nor excluding two or more such elements.

What is claimed is:

1. A bearing assembly for a mixing vessel, the bearing assembly comprising:

a supporting structure having:

a fitting;

a plurality of legs, each leg further comprising:

a middle portion coupled to the fitting;

a bottom end extending from the middle portion and configured to securely engage the vessel; and a top end extending from the middle portion away from the bottom end; and a guide bearing having an interior surface defining a bore adapted to receive a shaft and an exterior surface having a plurality of grooves each adapted to removably receive a top end of one of the plurality of legs such that the guide bearing is adapted to be removably engaged by the supporting structure; the guide bearing being removable from the supporting structure and shaft without necessitating removal or lifting of the shaft.

2. The bearing assembly of claim 1, wherein the guide bearing includes a top edge and a bottom edge, and wherein the exterior surface further includes a plurality of slots extending from the top edge to the bottom edge, the plurality of slots being adapted to slidably receive the top ends of the plurality of legs.

3. The bearing assembly of claim 2, wherein each of the plurality of grooves extends from the bottom edge toward the top edge, and terminates partway toward the top edge.

4. The bearing assembly of claim 1, wherein the guide bearing further includes a top edge a bottom edge, a channel disposed therebetween, the channel extending around the exterior surface; and a plurality of slots extending from the top edge to the channel, the plurality of slots adapted to slidably receive the top ends of the plurality of legs.

5. The bearing assembly of claim 4, wherein each of the plurality of grooves extends from the channel toward the top edge, and terminates partway toward the top edge.

6. The bearing assembly of claim 1, wherein the grooves are configured such that when the top ends of the legs are received therein, the contact area between the guide hearing and the supporting structure is minimized.

7. The bearing assembly of claim 6, wherein the grooves are configured such that when the top ends of the legs are received therein, the contact area between the guide bearing and the supporting structure is restricted to the contact between the grooves of the guide bearing and the top ends of the legs.

8. The bearing assembly of claim 1, wherein the guide bearing includes a top edge and a bottom edge, and wherein the bottom edge is configured to receive an o-ring.

* * * * *